US012523443B2

(12) United States Patent
Matthews

(10) Patent No.: US 12,523,443 B2
(45) Date of Patent: Jan. 13, 2026

(54) HANDGUN STABILIZER AND METHODS

(71) Applicant: SureFire, LLC, Fountain Valley, CA (US)

(72) Inventor: John W. Matthews, Newport Beach, CA (US)

(73) Assignee: SureFire, LLC, Fountain Valley, CA (US)

( * ) Notice: Subject to any disclaimer, the term of this patent is extended or adjusted under 35 U.S.C. 154(b) by 13 days.

(21) Appl. No.: 18/606,382

(22) Filed: Mar. 15, 2024

(65) Prior Publication Data

US 2025/0224198 A1 Jul. 10, 2025

Related U.S. Application Data

(60) Provisional application No. 63/452,511, filed on Mar. 16, 2023.

(51) Int. Cl.
*F41C 23/12* (2006.01)
*F41C 27/04* (2006.01)
*F41H 5/12* (2006.01)

(52) U.S. Cl.
CPC ..... *F41C 23/12* (2013.01); *F41C 27/04* (2013.01); *F41H 5/12* (2013.01)

(58) Field of Classification Search
CPC ..... F41C 23/12; F41C 27/04
See application file for complete search history.

(56) References Cited

U.S. PATENT DOCUMENTS 7,437,847 B1 * 10/2008 Mabry ..... F41C 23/04 42/73
2007/0131103 A1 * 6/2007 McClellan ..... F41H 5/12 89/37.03
2011/0056366 A1 * 3/2011 Ran ..... F41H 5/12 89/36.06
2014/0053447 A1 * 2/2014 Singh ..... F41C 23/06 42/71.02
2016/0061558 A1 * 3/2016 Gilmer ..... F41C 23/12 42/71.02

* cited by examiner

*Primary Examiner* — J. Woodrow Eldred
(74) *Attorney, Agent, or Firm* — Rutan & Tucker LLP; Hani Z. Sayed

(57) ABSTRACT

An apparatus and methods are provided for a handgun stabilizer that enables a shooter to very accurately fire a handgun while remaining well protected by a ballistic shield and looking through a bullet resistant viewing window comprising the ballistic shield. A high visibility green laser sight/high output white light illumination system may be mounted onto the handgun for aiming and illumination, with the handgun being precisely and removably mounted to the side of the handgun stabilizer at a location where the handgun's grip can be ergonomically grasped in the shooter's dominant hand, both for operating the handgun and for controlling the position and orientation of the ballistic shield for aiming purposes. An interface that enables the handgun to be precisely and removably mounted to the handgun stabilizer may comprise a quick-draw holster that is mounted directly onto the handgun stabilizer.

20 Claims, 3 Drawing Sheets

HANDGUN STABILIZER AND METHODS

PRIORITY

This application claims the benefit of and priority to U.S. Provisional Application, entitled "Handgun Stabilizer And Methods," filed on Mar. 16, 2023, and having application Ser. No. 63/452,511, the entirety of said application being incorporated herein by reference.

FIELD

Embodiments of the present disclosure generally relate to ballistic shields and firearms. More specifically, embodiments of the disclosure relate to a handgun stabilizer and methods for improving aiming of a handgun and shooting accuracy while providing greater protection to the shooter.

BACKGROUND

Law enforcement officers routinely encounter unpredictable scenarios that may threaten the public, their colleagues, or themselves. In such situations, officers may be required to use firearms, such as handguns, wherein shooting accuracy is crucial. However, handguns are well-known to require extreme precision for accurate shooting. In general, handguns have short barrels and short sight radii, which causes any minor misalignment in the sights to result in a relatively large change in aiming angle. Unfortunately, in high-stress situations sympathetic nervous reactions due to adrenaline, anxiety, and/or fear can negatively impact fine motor skills required for accurately firing a handgun. What is needed, therefore, is a handgun stabilizer for improving shooting accuracy and aiming of a handgun while providing greater protection to the user.

SUMMARY

An apparatus and methods are provided for a handgun stabilizer that enables a shooter to very accurately fire a handgun while remaining well protected by a ballistic shield and looking through a bullet resistant viewing window comprising all or a significant portion of the ballistic shield. A high visibility green laser sight/high output white light illumination system may be mounted onto the handgun for aiming and illumination, as well as a red dot sight and open sight for aiming, with the handgun being precisely and removably mounted to the side of the handgun stabilizer at a location where the handgun's grip can be ergonomically grasped in the shooter's dominant hand, both for operating the handgun and for controlling the position and orientation of the ballistic shield for aiming purposes. An interface that enables the handgun to be precisely and removably mounted to the handgun stabilizer may comprise a quick-draw holster that is mounted directly onto the handgun stabilizer.

In an exemplary embodiment, a handgun stabilizer comprises: a vertical stabilizer and a horizontal stabilizer; mounting hardware for joining the vertical stabilizer and the horizontal stabilizer; and an interface for precisely and removably receiving the handgun.

In another exemplary embodiment, the interface is coupled with the vertical stabilizer and the horizontal stabilizer by way of the mounting hardware. In another exemplary embodiment, the interface is configured to mate with the handgun such that a light/laser sight disposed on the handgun remain unobstructed, as well as any open or red dot sights that are on the handgun. In another exemplary embodiment, the interface comprises a male portion that is configured to receive the handgun comprising a female portion. In another exemplary embodiment, the interface comprises a quick draw holster that is coupled with the vertical stabilizer and the horizontal stabilizer by way of the mounting hardware.

In another exemplary embodiment, the handgun stabilizer further comprises a ballistic shield coupled to vertical stabilizer and the horizontal stabilizer for protecting a shooter. In another exemplary embodiment, the ballistic shield includes a ballistic window configured to provide an unobstructed view of a light/laser sight, a red dot sight, and open sights disposed on the handgun. In another exemplary embodiment, the ballistic shield comprises a transparent material. In another exemplary embodiment, the transparent material comprises a polycarbonate or layered glass plus polycarbonate sheet having a thickness of about ¾". In another exemplary embodiment, the polycarbonate or layered glass plus polycarbonate sheet has an area of at least about 1.0 square feet.

In another exemplary embodiment, the handgun stabilizer further comprises a cheek weld riser coupled with the horizontal stabilizer. In another exemplary embodiment, the cheek weld riser is adapted to receive a cheek of a shooter during aiming and/or firing the handgun.

In another exemplary embodiment, the vertical stabilizer is configured to be grasped in a nondominant hand of a shooter. In another exemplary embodiment, the vertical stabilizer is adapted to stabilize at least rotation of a dominant hand of the shooter during grasping and/or aiming of the handgun. In another exemplary embodiment, the vertical stabilizer is further adapted to enable the shooter to support the weight of the handgun stabilizer with the end of the horizontal stabilizer held against the shoulder.

In another exemplary embodiment, the horizontal stabilizer extends rearward from the vertical stabilizer toward a shoulder of a shooter. In another exemplary embodiment, the horizontal stabilizer is configured to contact the shoulder during aiming and/or firing the handgun. In another exemplary embodiment, the horizontal stabilizer is adapted to stabilize at least vertical angle of a dominant hand of the shooter during grasping and/or aiming of the handgun. In another exemplary embodiment, the horizontal stabilizer includes a cheek weld riser adapted to contact the cheek of the shooter to further enhance stability during aiming and/or firing the handgun.

In an exemplary embodiment, a method for a handgun stabilizer comprises: providing a vertical stabilizer and a horizontal stabilizer; joining the vertical stabilizer and the horizontal stabilizer by way of mounting hardware; configuring an interface to precisely and removably receive the handgun; and coupling the interface with the vertical stabilizer and the horizontal stabilizer by way of the mounting hardware.

In another exemplary embodiment, the method further comprises coupling a ballistic shield with the vertical stabilizer and the horizontal stabilizer for protecting a shooter. In another exemplary embodiment, the method further comprises coupling a cheek weld riser with the horizontal stabilizer to receive a cheek of a shooter during aiming and/or firing the handgun.

These and other features of the concepts provided herein may be better understood with reference to the drawings, description, and appended claims.

BRIEF DESCRIPTION OF THE DRAWINGS

The drawings refer to embodiments of the present disclosure in which.

Figure 1:
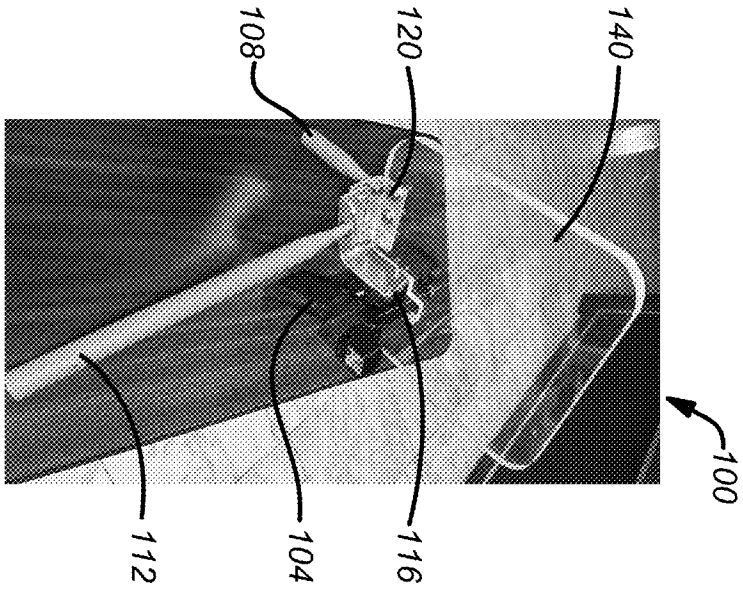
FIG. 1 illustrates a forward view of an exemplary embodiment of a handgun stabilizer with a handgun precisely and removably coupled with horizontal and vertical stabilizers by way of an interface.

While the present disclosure is subject to various modifications and alternative forms, specific embodiments thereof have been shown by way of example in the drawings and will herein be described in detail. The present disclosure should be understood to not be limited to the particular forms disclosed, but on the contrary, the intention is to cover all modifications, equivalents, and alternatives falling within the spirit and scope of the present disclosure.

DETAILED DESCRIPTION

In the following description, numerous specific details are set forth in order to provide a thorough understanding of the present disclosure. It will be apparent, however, to one of ordinary skill in the art that the ballistic shield system and methods disclosed herein may be practiced without these specific details. In other instances, specific numeric references such as "first stabilizer," may be made. However, the specific numeric reference should not be interpreted as a literal sequential order but rather interpreted that the "first stabilizer" is different than a "second stabilizer." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

A handgun stabilizer is provided herein that enables an individual to very accurately fire a handgun at opponents while being well protected by a ballistic shield and looking through a bullet resistant viewing window. The handgun stabilizer can incorporate a high visibility green laser sight/high output white light illumination system for aiming and illumination that is mounted on the handgun. The handgun is precisely but removably mounted by way of an interface to the side of the ballistic shield at a location where the handgun's pistol grip can be ergonomically grasped by the shooter's dominant hand, for controlling the position and orientation of the stabilizer for aiming the handgun as well as for accurately firing the handgun. The interface that precisely and removably mounts the handgun onto the stabilizer may be a female portion that is built into the light/laser sight system being used, with a male portion being built into a mount, similar to a Surefire Masterfire quick-draw holster, that is mounted directly to the stabilizer.

FIGS. 1-4 illustrate an exemplary embodiment of a handgun stabilizer 100 with a handgun 104 precisely and removably coupled with vertical stabilizer 108 and a horizontal stabilizer 112 by way of an interface 116. As shown in FIG. 1, the interface 116 is coupled with the vertical and horizontal stabilizers 108, 112 by way of mounting hardware 120. The mounting hardware 120 may comprise any suitable fastening assembly whereby the vertical and horizontal stabilizers 108, 112 may be joined. In the exemplary embodiment shown in FIGS. 1-4, the mounting hardware 120 comprises nuts, bolts, and brackets that fasten together the vertical and horizontal stabilizers 108, 112 and the interface 116.

As mentioned herein, the interface 116 is configured to precisely and removably mount the handgun 104 onto the stabilizer 100 similarly to a quick draw holster, such as, for example, a Surefire Masterfire quick-draw holster. The interface 116 is configured to mate with the handgun 104 such that a light/laser sight 124 disposed on the handgun 104 remains unobstructed. In some embodiments, the interface 116 comprises a female portion that is fastened onto the stabilizer 100 and is configured to receive the handgun 104 comprising a male portion. It is contemplated, however, that in some embodiments, the interface 116 may comprise a male portion that is built into a quick-draw holster that is configured to receive a female portion comprising the light/laser sight 124 disposed on the handgun 104. It is contemplated that in such embodiments, the quick-draw holster may be mounted directly to the mounting hardware 120, without limitation.

As will be recognized by those skilled in the art, the handgun 104 generally is grasped by a shooter's dominant hand. As such, the vertical stabilizer 108 is configured to be grasped in the shooter's nondominant hand. The vertical stabilizer 108 is adapted to enable the shooter to support the weight of the handgun stabilizer 100 while aiming the handgun 104. Further, the vertical stabilizer 108 is adapted to stabilize at least rotation of the shooter's dominant hand while grasping and/or aiming of handgun 104. As such, the vertical stabilizer 108 cooperates with the horizontal stabilizer 112 to effectively lock the shooter's wrist, thereby eliminating a need for fine motor skills during aiming and firing the handgun 104 and thus enhancing the shooter's accuracy with the handgun 104.

Figure 5:
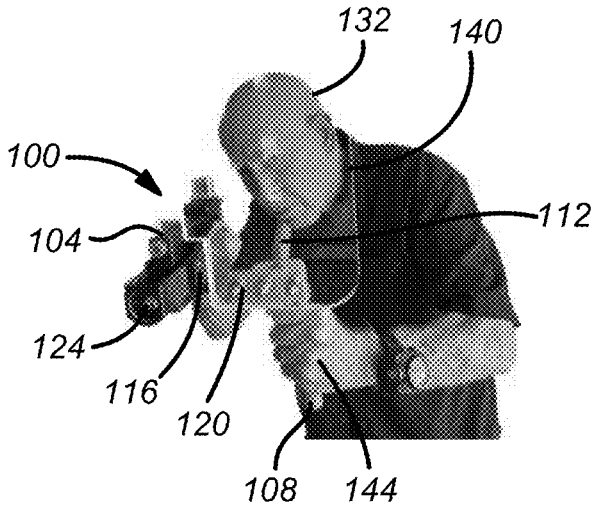
FIG. 5 illustrates an exemplary-use environment wherein a shooter uses the handgun stabilizer of FIG. 2 to accurately operate the handgun while remaining protected behind a ballistic shield and viewing targets through a ballistically protected viewport.
Figure 6:
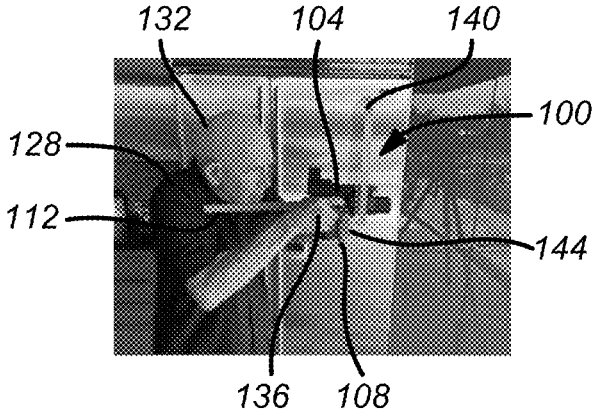
FIG. 6 illustrates a side view of an exemplary-use environment wherein a shooter uses a horizontal stabilizer comprising the handgun stabilizer of FIG. 5 to accurately aim the handgun.
Figure 7:
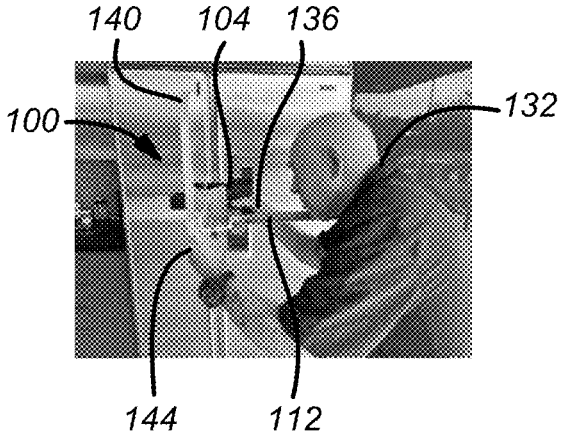
FIG. 7 illustrates a side view of an exemplary-use environment wherein a shooter uses a vertical stabilizer comprising the handgun stabilizer of FIG. 5 to accurately aim the handgun, in accordance with the present disclosure.

The horizontal stabilizer 112 generally is coupled with the vertical stabilizer 108 by way of the mounting hardware 120 and extends rearward from the vertical stabilizer 108. As shown in FIGS. 5-7, the horizontal stabilizer 112 is configured to contact a shoulder 128 of a shooter 132 during aiming and/or firing the handgun 104. In particular, the horizontal stabilizer 112 is adapted to stabilize at least a vertical angle of a dominant hand 136 of the shooter 132 during grasping and/or aiming of the handgun 104. As such, the horizontal stabilizer 112 cooperates with the vertical stabilizer 108 to effectively lock the shooter's 132 wrist, as described above, and thus the stabilizers 108, 112 eliminate a need for fine motor skills during aiming and firing the handgun 104, enhancing the shooter's 132 accuracy with the handgun 104. Further, in some embodiments, the horizontal stabilizer 112 may include a cheek weld riser (not shown) adapted to contact the cheek of the shooter 132 to further enhance stability during aiming and/or firing the handgun 104. It is contemplated that the cheek weld riser can be separate component that may be mounted onto the horizontal stabilizer 112, or the cheek weld riser and the horizontal stabilizer 112 may comprise a monolithic component, without limitation.

Figure 2:
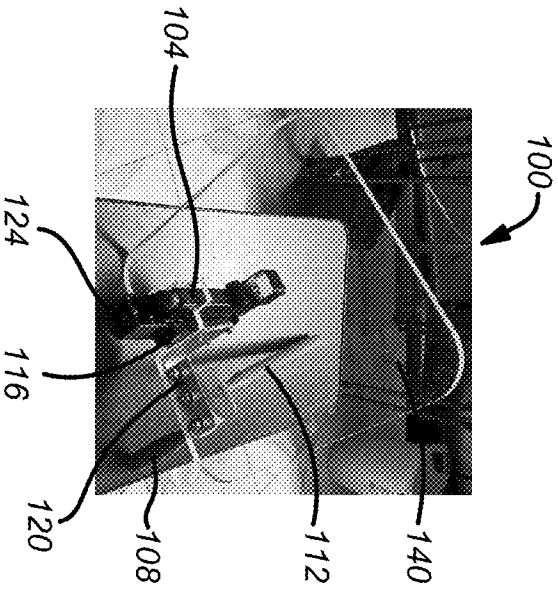
FIG. 2 illustrates a rearward view of an exemplary embodiment of a handgun stabilizer with a handgun precisely and removably coupled with horizontal and vertical stabilizers by way of an interface.
Figure 3:
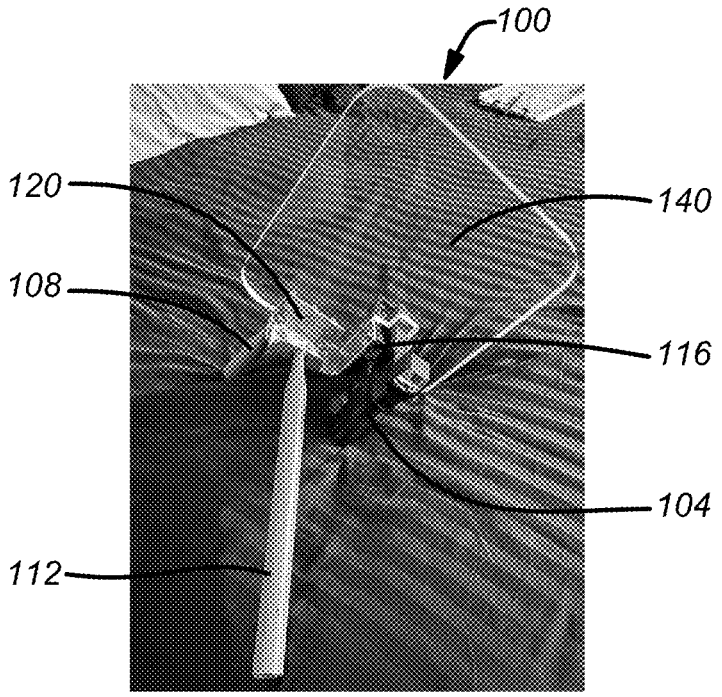
FIG. 3 illustrates an exemplary embodiment of a handgun stabilizer with a handgun precisely and removably coupled with horizontal and vertical stabilizers by way of an interface.
Figure 4:
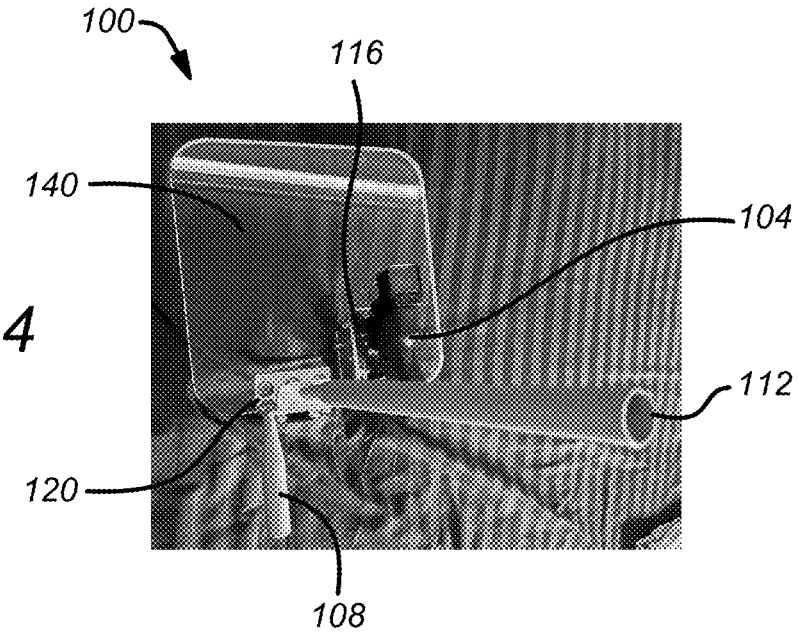
FIG. 4 illustrates an exemplary embodiment of a handgun stabilizer with a handgun precisely and removably coupled with horizontal and vertical stabilizers by way of an interface.

In the illustrated embodiment, the handgun stabilizer 100 includes an optional ballistic shield 140 that is coupled with the vertical and horizontal stabilizers 108, 112. In general, the ballistic shield 140 is configured for protecting the shooter's 132 head and face while allowing the shooter 132 to aim and fire the handgun 104. As shown in FIGS. 1-2, the ballistic shield 140 may be coupled with the handgun stabilizer 100 by way of the mounting hardware 120. In some embodiments, the ballistic shield 140 includes a ballistic window configured to provide an unobstructed view of the light/laser sight 124 disposed on the handgun 104. In some embodiments, however, the ballistic shield 140 comprises a transparent material. For example, in an embodiment, the ballistic shield 140 comprises an acrylic sheet having a thickness of about ¾" and an area of at least about 1.0 square feet, giving the handgun stabilizer 100 a weight of about 8.5 lbs. It is contemplated that the handgun stabilizer 100 with the ballistic shield 140 is much more manageable than using larger shields. However, it should be borne in mind that the ballistic shield 140 not limited to the illustrated embodiment shown herein, nor is the ballistic shield 140 limited to 1.0 square feet, but rather the ballistic shield 140 may be thicker and include more area as desired, without limitation.

FIGS. 5-7 illustrate an exemplary-use environment wherein a shooter 132 uses the handgun stabilizer 100 to accurately operate a handgun 104 while remaining protected behind a ballistic shield 140. It is contemplated that when the shooter 132 needs improved shooting accuracy, such as during stressful situations or emergencies, the shooter 132 can remove the handgun 104 from a belt holster and simply click the handgun 104 into the interface 116, as described herein. With the handgun 104 precisely and removably engaged with the interface 116, the shooter 132 can grasp the handgun 104 with a dominant hand 136 while grasping the vertical stabilizer 108 with a nondominant hand 144. Upon the shooter 132 supporting the horizontal stabilizer 112 by way of a shoulder 128, the handgun stabilizer 100 obviates a need for fine motor control and thus enables the shooter 132 to operate the handgun 104 during emergency situations without the negative effects of anxiety. Further, once the handgun stabilizer 100 is no longer needed, the shooter 132 can simply unclick the handgun 104 from the interface 116 and return the handgun 104 to the belt holster, as needed.

While the handgun stabilizer and methods have been described in terms of particular variations and illustrative figures, those of ordinary skill in the art will recognize that the handgun stabilizer is not limited to the variations or figures described. In addition, where methods and steps described above indicate certain events occurring in certain order, those of ordinary skill in the art will recognize that the ordering of certain steps may be modified and that such modifications are in accordance with the variations of the handgun stabilizer. Additionally, certain of the steps may be performed concurrently in a parallel process when possible, as well as performed sequentially as described above. To the extent there are variations of the handgun stabilizer, which are within the spirit of the disclosure or equivalent to the handgun stabilizer found in the claims, it is the intent that this patent will cover those variations as well. Therefore, the present disclosure is to be understood as not limited by the specific embodiments described herein, but only by scope of the appended claims.

What is claimed is:

1. A firearm stabilizer, comprising:

a vertical stabilizer and a horizontal stabilizer;

mounting hardware for joining the vertical stabilizer and the horizontal stabilizer; and an interface for precisely and removably receiving a handgun and further wherein the interface is coupled to both the vertical stabilizer and the horizonal stabilizer via mounting hardware that extends rearward from the vertical stabilizer.

2. The firearm stabilizer stabilizer of claim 1, wherein the interface is configured to mate with the handgun wherein the handgun includes at least a light sight and/or laser sight attached thereto and wherein the light/laser sight disposed on the handgun remain unobstructed when such handgun is attached to the firearm stabilizer.

3. The firearm stabilizer of claim 2, wherein the interface comprises a male portion positioned thereon that is configured to receive a corresponding female portion positioned on the handgun comprising a female portion.

4. The firearm stabilizer of claim 1, wherein the interface comprises a quick draw holster that is coupled with the vertical stabilizer and the horizontal stabilizer by way of the mounting hardware.

5. The firearm stabilizer of claim 1, further comprising a ballistic shield coupled to vertical stabilizer and the horizontal stabilizer for protecting a shooter.

6. The firearm stabilizer of claim 5, wherein the ballistic shield includes a ballistic window configured to provide an unobstructed view of open sights and/or a red dot sight disposed on the handgun.

7. The firearm stabilizer of claim 5, wherein the ballistic shield comprises a transparent material.

8. The firearm stabilizer of claim 7, wherein the transparent material is comprised of a polycarbonate sheet wherein said polycarbonate sheet having a thickness of about ¾".

9. The firearm stabilizer of claim 8, wherein the polycarbonate sheet has an area of at least about 1.0 square feet.

10. The firearm stabilizer of claim 1, further comprising a cheek weld riser coupled with the horizontal stabilizer, the cheek weld riser being adapted to receive a cheek of a shooter during aiming and/or firing the handgun with the end of the horizontal stabilizer in contact with the shooter's shoulder.

11. The firearm stabilizer of claim 1, wherein the vertical stabilizer is configured to be grasped in a nondominant hand of a shooter.

12. The firearm stabilizer of claim 11, wherein a vertical stabilizer is provided to stabilize the hand of the shooter during grasping and/or aiming of the handgun.

13. The firearm stabilizer of claim 1, wherein the a vertical stabilizer is provided to enable the shooter to support the weight of the handgun stabilizer.

14. The firearm stabilizer of claim 1, wherein the horizontal stabilizer extends rearward from the vertical stabilizer toward and contacting a shoulder of a shooter.

15. The firearm stabilizer of claim 14, wherein the horizontal stabilizer is configured to contact the shoulder during aiming and/or firing the handgun.

16. The firearm stabilizer of claim 15, wherein the horizontal stabilizer is adapted to stabilize at least the vertical angle of a dominant hand of the shooter during grasping and/or aiming of the handgun.

17. A method making a firearm stabilizer, comprising:

providing a vertical stabilizer and a horizontal stabilizer;

joining the vertical stabilizer and the horizontal stabilizer by way of mounting hardware whereby the mounting hardware extends rearward from the vertical stabilizer;

configuring an interface to precisely and removably receive the handgun wherein the interface is coupled to both the vertical stabilizer and the horizonal stabilizer; and coupling the interface with the vertical stabilizer and the horizontal stabilizer by way of the mounting hardware.

18. The method of claim 17, further comprising coupling a transparent ballistic shield with the vertical stabilizer and the horizontal stabilizer for protecting a shooter's head and neck.

19. The method of claim 17, further comprising coupling a cheek weld riser with the horizontal stabilizer to receive a cheek of a shooter during aiming and/or firing the handgun with the end of the horizontal stabilizer in contact with the shoulder.

20. The method of claim 19, wherein an opaque ballistic shield material is provided to protect the shooter's arms and upper body, the opaque ballistic shield being coupled with the transparent ballistic shield material that is protecting the shooter's head and neck.

* * * * *